US007470307B2

(12) United States Patent
Larink, Jr.

(10) Patent No.: US 7,470,307 B2
(45) Date of Patent: Dec. 30, 2008

(54) METAL POWDERS AND METHODS FOR PRODUCING THE SAME

(75) Inventor: Steven C. Larink, Jr., Tucson, AZ (US)

(73) Assignee: Climax Engineered Materials, LLC, Phoenix, AZ (US)

( * ) Notice: Subject to any disclaimer, the term of this patent is extended or adjusted under 35 U.S.C. 154(b) by 535 days.

(21) Appl. No.: 11/092,023

(22) Filed: Mar. 29, 2005

(65) Prior Publication Data

US 2006/0219056 A1 Oct. 5, 2006

(51) Int. Cl.
*B22F 9/06* (2006.01)

(52) U.S. Cl. ..... 75/345; 75/365

(58) Field of Classification Search ..... 75/395, 75/365

See application file for complete search history.

(56) References Cited

U.S. PATENT DOCUMENTS

| | | | | |
|---|---|---|---|---|
| 2,898,978 | A | 8/1959 | Kitchen et al. | |
| 3,592,395 | A * | 7/1971 | Lockwood et al. | 241/18 |
| 3,617,358 | A | 11/1971 | Dittrich | |
| 3,865,586 | A | 2/1975 | Volin et al. | |
| 4,028,095 | A | 6/1977 | Laferty, Jr. et al. | |
| 4,146,388 | A | 3/1979 | Lafferty et al. | |
| 4,502,885 | A | 3/1985 | Cheney | |
| 4,592,781 | A | 6/1986 | Cheney et al. | |
| 4,613,371 | A | 9/1986 | Cheney et al. | |
| 4,670,047 | A | 6/1987 | Kopatz et al. | |
| 4,687,510 | A | 8/1987 | Cheney et al. | |
| 4,708,159 | A | 11/1987 | Lockwood, Jr. | |
| 4,767,313 | A | 8/1988 | Lockwood, Jr. | |
| 4,778,516 | A | 10/1988 | Raman | |
| 4,802,915 | A | 2/1989 | Kopatz et al. | |
| 4,819,873 | A | 4/1989 | Lockwood, Jr. | |
| 4,838,784 | A | 6/1989 | Lockwood, Jr. | |
| 4,941,820 | A | 7/1990 | Lockwood, Jr. | |
| 4,976,778 | A | 12/1990 | Berry et al. | |
| 4,992,039 | A | 2/1991 | Lockwood, Jr. | |
| 4,992,043 | A | 2/1991 | Lockwood, Jr. | |
| 5,124,091 | A | 6/1992 | Paliwal et al. | |
| 5,173,108 | A | 12/1992 | Houck | |
| 5,197,399 | A | 3/1993 | Mansour | |
| 5,252,061 | A | 10/1993 | Ozer et al. | |
| 5,255,634 | A | 10/1993 | Mansour | |
| 5,482,530 | A | 1/1996 | Hohne | |
| 5,658,142 | A | 8/1997 | Kitchen et al. | |

(Continued)

FOREIGN PATENT DOCUMENTS

| | | | |
|---|---|---|---|
| JP | 5311212 | A | 11/1993 |

OTHER PUBLICATIONS

Unknown, "Successful Tests: Materials Sucessfully Dried in PCS Dryers as of Jun. 2001, 161 Materials," Web Page, Downloaded Mar. 28, 2005, http://www.pulsedry.com/materials.html.

(Continued)

*Primary Examiner*—George Wyszomierski
(74) *Attorney, Agent, or Firm*—Fennemore Craig, P.C.

(57) ABSTRACT

A method for producing a metal powder product involves: Providing a supply of a precursor metal powder; combining the precursor metal powder with a liquid to form a slurry; feeding the slurry into a pulsating stream of hot gas; and recovering the metal powder product.

6 Claims, 7 Drawing Sheets

U.S. PATENT DOCUMENTS

| | | | |
|---|---|---|---|
| 5,842,289 | A | 12/1998 | Chandran et al. |
| 6,114,048 | A | 9/2000 | Jech et al. |
| 6,470,597 | B1 | 10/2002 | Stipp |
| 6,548,197 | B1 | 4/2003 | Chandran et al. |
| 6,733,562 | B2 | 5/2004 | Knunz et al. |
| 2002/0134198 | A1 | 9/2002 | Edlinger |
| 2002/0150528 | A1 | 10/2002 | Maus et al. |
| 2004/0216558 | A1 | 11/2004 | Mariani |
| 2006/0051288 | A1* | 3/2006 | Tsurumi et al. ..... 423/608 |

OTHER PUBLICATIONS

International Preliminary Report on Patentability dated Nov. 16, 2007 for PCT Application No. PCT/US2006/010883 (8 pages).

* cited by examiner

CONVENTIONAL SPRAY DRY BATCHES 1-2

METAL POWDERS AND METHODS FOR PRODUCING THE SAME

TECHNICAL FIELD

This invention relates to metal powders in general and more specifically to processes for producing metal powders.

BACKGROUND

Several different processes for producing powdered metal products have been developed and are currently being used to produce metal powders having certain characteristics, such as increased densities and increased flowabilities, that are desirable in subsequent metallurgical processes, such as, for example, sintering and plasma-spraying processes.

One process, known as plasma-based densification, involves contacting a metal precursor material with a hot plasma jet. The hot plasma jet liquefies and/or atomizes the metal in order to form small, generally spherically shaped particles. The particles are then allowed to re-solidify before being recovered. The resulting powdered metal product is often characterized by having a high flowability and high density, thereby making the powdered metal product desirable for use in subsequent processes (e.g., sintering and plasma-spraying).

Unfortunately, however, plasma-based densification processes are not without their drawbacks. For example, plasma-based densification processes tend to be expensive to implement, are energy-intensive, and also suffer from comparatively low yields.

Another type of process, known as spray drying, involves a process wherein a solution or slurry containing the desired metal is rapidly dried to particulate form by atomizing the liquid in a hot atmosphere. One type of spray drying process for producing a powdered metal product utilizes a rotating atomizing disk provided in a heated process chamber. A liquid precursor material (e.g., a slurry or solution) containing a powdered metal material is directed onto the rotating disk. The liquid precursor material is accelerated generally outwardly by the rotating disk. The heated chamber speeds the evaporation of the liquid component of the liquid precursor material as the same is accelerated outwardly by the rotating disk. The resulting powdered metal end product is then collected from a perimeter wall surrounding the rotating disk.

While the foregoing spray drying process is often used to form a powdered metal product, it is not without its disadvantages. For example, spray drying processes also tend to suffer from comparatively low yields and typically result in a metal powder product having a lower density than is possible with plasma-based densification processes. Spray drying processes also involve fairly sizable apparatus (e.g., atomizing disks having diameters on the order of 10 m) and are energy intensive. The spray drying process also tends to be difficult to control, and it is not unusual to encounter some degree of variability in the characteristics of the powdered metal product, even though the process parameters remain the same. Such variability further increases the difficulty in producing a final powdered metal product having the desired characteristics.

Consequently, a need remains for a system capable of producing a powdered metal end product having characteristics, such as high density and high flowability, that make the powdered metal end product more desirable for use in subsequent applications. Ideally, such a system should be capable of producing increased yields of powdered metal end product, while at the same time involving less complexity, energy, and expense when compared to conventional processes.

SUMMARY OF THE INVENTION

A method for producing a metal powder product according to one embodiment of the invention may comprise: Providing a supply of a precursor metal powder; combining the precursor metal powder with a liquid to form a slurry; feeding the slurry into a pulsating stream of hot gas; and recovering the metal powder product.

Also disclosed is a metal powder product comprising agglomerated metal particles having a Hall flowability of less than about 30 seconds for 50 grams.

BRIEF DESCRIPTION OF THE DRAWINGS

Illustrative and presently preferred exemplary embodiments of the invention are shown in the drawings in which.

DETAILED DESCRIPTION

Figure 1:
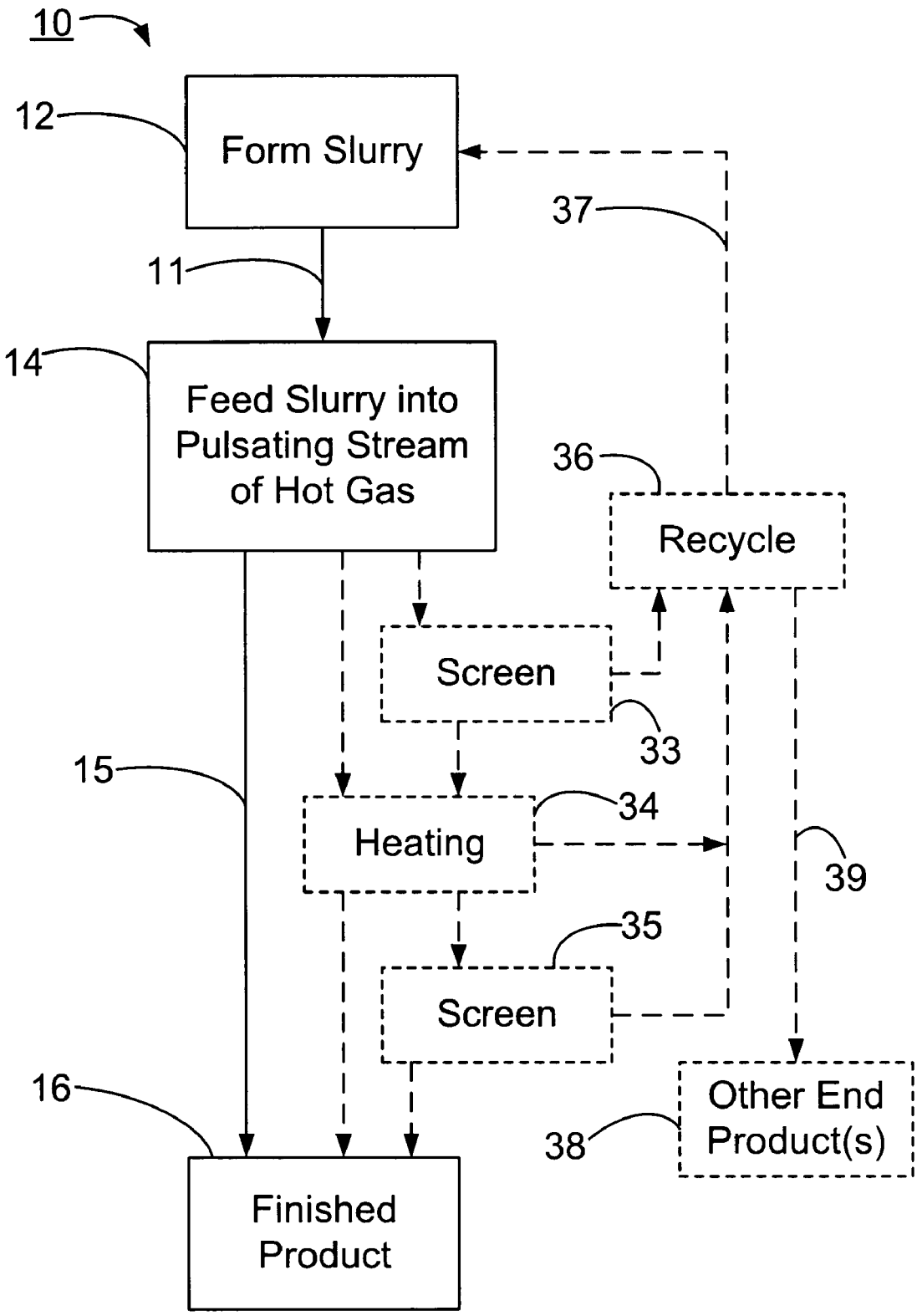
FIG. 1 is a flowchart depicting a method according to the invention(s) hereof.
Figure 2:
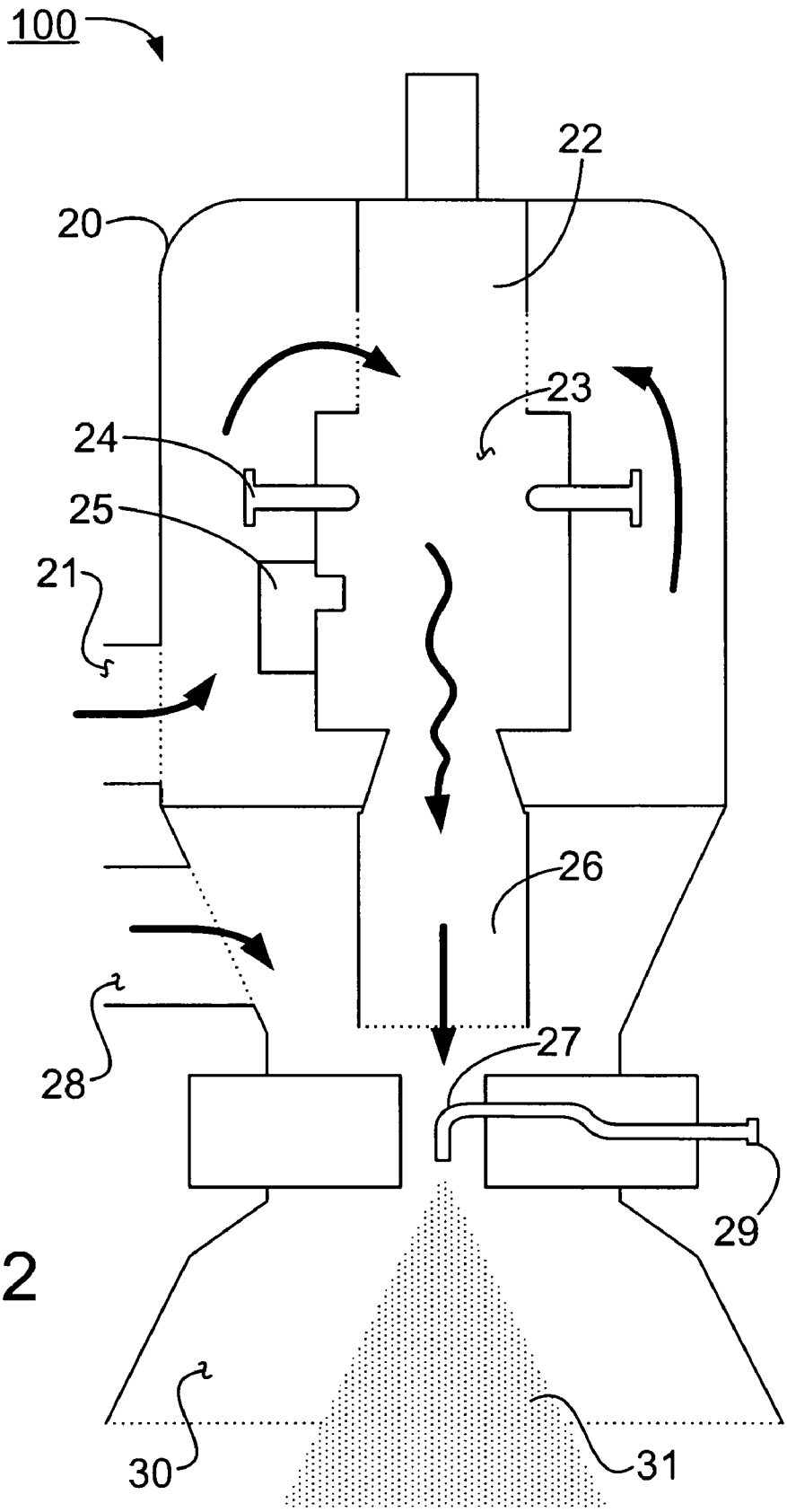
FIG. 2 is a sectional view of a pulse combustion system which may be used in and/or with the present invention.

A method 10 for producing a metal powder product is illustrated in FIG. 1 and comprises providing a supply of precursor metal powder and mixing the precursor metal powder with a liquid to form a slurry at step 12. The slurry is then fed into a pulsating stream of hot gas 14. In one embodiment, the pulsating stream of hot gas is produced by a pulse combustion system 100 (FIG. 2). The metal powder product is then recovered at step 16. As will be described in greater detail below, the recovered metal powder product comprises agglomerations of smaller particles having higher densities and higher flowabilities when compared to metal powders produced by conventional spray drying processes.

More specifically, a basic process hereof first includes the formation of a slurry at step 12 containing the precursor metal powder. In a typical example, the precursor metal powder is mixed with a liquid (e.g., water) to form the slurry, although other liquids, such as alcohols, volatile liquids, and organic liquids, may be used. In one embodiment, the liquid component of the slurry comprises a water and binder mixture which may initially be created by mixing together a binder, such as, for example, polyvinyl alcohol (PVA), and water. The precursor metal powder, such as, for example, a molybdenum powder (see the Examples set forth below), is then added to the water/binder mixture to form the slurry.

It should be noted, however, that it may be necessary or desirable to pre-heat the liquid mixture before adding the precursor metal powder in order to ensure that the binder is fully dissolved in the liquid "carrier." The particular temperatures involved may depend to some degree on the particular liquid carrier (e.g., water) and binder (e.g., PVA) selected. Therefore, the present invention should not be regarded as limited to any particular temperature or range of temperatures for pre-heating the liquid mixture. However, by way of example, in one embodiment, the liquid mixture may be pre-heated to a temperature in a range of about 35° C. to about 100° C.

The slurry may comprise between about 60 to about 99 wt. % solids, such as about 60% to about 90% wt. % solids, and more preferably about 80% wt. % solids. The slurry may comprise between about 1 to about 40 wt. % liquid, such as about 10 to about 40 wt. % liquid, and more preferably about 20 wt. % liquid. The liquid component may comprise about 0.01 to about 5 wt. % binder, such as about 0.4 to about 0.9 wt. % binder, and more preferably about 0.7 wt. % binder. In one embodiment, the slurry comprises about 80 wt. % solids and about 20 wt. % liquid, of which about 0.7 wt. % is binder. The precursor metal powder may have sizes in a range of about sub-micron sizes (e.g., from about 0.25 μm to about 100 μm, such as about 1 μm to about 20 μm, and more preferably in a size range of about 5 μm to about 6 μm.

The slurry is then fed into a pulse combustion system 100 (FIG. 2) whereupon the slurry impinges a stream of hot gas (or gases), which are pulsed at or near sonic speeds. The sonic pulses of hot gas contact the slurry and drive-off substantially all of the water and form the metal powder product. The temperature of the pulsating stream of hot gas may be in a range of about 300° C. to about 800° C., such as about 427° C. to about 677° C., and more preferably about 600° C., although other temperatures may be used depending on the particular precursor metal powder being processed. Generally speaking, the temperature of the pulsating stream of hot gas is below the melting point of the precursor metal powder being processed. In addition, the precursor metal powder in the slurry is usually not in contact with the hot gases long enough to transfer a significant amount of heat to the metal powder. For example, in a typical embodiment, it is estimated that the slurry mixture is generally heated to a temperature in the range of about 93° C. to about 121° C. during contact with the pulsating stream of hot gas.

As will be described in greater detail herein, the resulting metal powder product comprises agglomerations of smaller particles that are substantially solid (i.e., non-hollow), and generally spherical in shape. Accordingly, the agglomerations may be generally characterized as "soccer balls formed of 'BBs'." In addition, the metal powder product comprises a high density and is highly flowable when compared to conventional metal powders produced by conventional processes. For example, molybdenum metal powders produced in accordance with the teachings herein may have Scott densities in a range of about 1 g/cc to about 4 g/cc, such as about 2.6 g/cc to about 2.9 g/cc. Hall flowabilities range from less than about 30 s/50 g to as low as 20-23 s/50 g for molybdenum metal.

With reference now primarily to FIG. 1, the method or process 10 for producing a metal powder product may comprise the making or forming of a slurry at step 12. Then, this slurry is exposed to a pulsating stream of hot gases at step 14, which yields desirable metal powder product at 16. The basic process is indicated by the solid line connection arrows 11 and 15 as opposed to the optional alternative process flows indicated by the dashed line arrows and boxes, generally identified by reference numerals 33-39, which are described below.

With reference now to FIG. 2, the pulsating stream of hot gases may be produced by a pulse combustion system 100 of the type that is well-known in the art and readily commercially available. By way of example, in one embodiment, the pulse combustion system 100 may comprise a pulse combustion system available from Pulse Combustion Systems of San Rafael, Calif., 94901. Initially, air may be fed (e.g., pumped) through an inlet 21 into the outer shell 20 of the pulse combustion system 100 at low pressure, whereupon it flows through a unidirectional air valve 22. The air then enters a tuned combustion chamber 23 where fuel is added via fuel valves or ports 24. The fuel-air mixture is then ignited by a pilot 25, creating a pulsating stream of hot gases which may be pressurized to a variety of pressures, e.g., about 2,000 Pa (3 psi) above the combustion fan pressure. The pulsating stream of hot gases rushes down the tailpipe 26 toward the atomizer 27. Just above the atomizer 27, quench air may be fed through an inlet 28 and may be blended with the hot combustion gases in order to attain a pulsating stream of hot gases having the desired temperature. The slurry is introduced into the pulsating stream of hot gases via the atomizer 27. The atomized slurry may then disperse in the conical outlet 30 in a general (though not necessarily) conical form 31 and thereafter enter a conventional tall-form drying chamber (not shown). Further downstream, the metal powder product may be recovered using standard collection equipment, such as cyclones and/or baghouses (also not shown).

In pulsed operation, the air valve 22 is cycled open and closed to alternately let air into the combustion chamber 23 and close for the combustion thereof. In such cycling, the air valve 22 may be reopened for a subsequent pulse just after the previous combustion episode. The reopening then allows a subsequent air charge to enter. The fuel valve 24 then re-admits fuel, and the mixture auto-ignites in the combustion chamber 23, as described above. This cycle of opening and closing the air valve 22 and combusting the fuel in the chamber 23 in a pulsing fashion may be controllable at various frequencies, e.g., from about 80 Hz to about 110 Hz, although other frequencies may also be used.

The pulse combustion system 100 thus provides a pulsating stream of hot gases into which is fed the slurry comprising the precursor metal powder. The contact zone and contact time are very short, the time of contact often being on the order of a fraction of a microsecond. Thus, the physical interactions of hot gas, sonic waves, and slurry produces the metal powder product. More specifically, the liquid component of the slurry is substantially removed or driven away by the sonic (or near sonic) pulse waves of hot gas. The short contact time also ensures that the slurry components are minimally heated, e.g., to levels on the order of about 93° C. to about 121° C. at the end of the contact time, temperatures which are sufficient to evaporate the liquid component, but are not near the melting point of the metal contained in the slurry.

In this process, some quantity of the liquid component (e.g., binder) remains in the resulting agglomerations of the metal powder product. The resulting powders may have this remaining binder driven off (e.g., partially or entirely), by a subsequent heating step 34. Generally speaking, heating step 34 is conducted at a temperature that is below the melting point of the metal powder product, thereby yielding a substantially pure (i.e., free of binder) metal powder product. It may also be noted that the agglomerations of the metal powder product preferably retain their shapes (in many cases, though not necessarily, substantially spherical), even after the binder is removed by heating step 34. Flowability data (Hall data) in heated and/or green forms are available (heated being after binder removal, green being pre-removal), as described relative to the Examples below.

Note further that in some instances, a variety of sizes of agglomerated products may be produced during this process, and it may be desirable to further separate or classify the metal powder product into a metal powder product having a size range within a desired product size range. For example, for molybdenum powder, sieve sizes of −200 to +325 U.S. Tyler mesh provide a metal powder product within a desired product size range of about 44 μm to 76 μm. A process hereof may yield a substantial percentage of product in this desired product size range; however, there may be remainder products, particularly the smaller products, outside the desired product size range which may be recycled through the system, see step 36, though liquid (e.g., water and binder) would again have to be added to create an appropriate slurry composition. Such recycling is shown as an optional alternative (or additional) step or steps in FIG. 1. These steps are shown particularly as the separation or screening step 33 with or without the additional heating and/or screening steps 34, 35 which may then feed any out-sized products (i.e., products either smaller or larger than the desired product size range) back to the recycling step 36, which in turn feeds back to the formation of a slurry step 12 as shown by arrow line 37. Alternatively, the results of the recycling step 36 can be the creation of or feed into alternative processes for the creation of other end products, see step 38 as fed thereby down arrow 39. These steps are shown also in FIGS. 3, 4 and 5 (in solid line form), and yet may be alternatives (as in FIG. 1) or may be primary steps in any one or more of the processes according hereto. Note, though not shown, the recycling process 36 can alternatively involve the feeding of one or more appropriate portions of the metal powder product of the combustion forming process back to the starting material step 40, see description thereof below, for in one example, size reduction by comminuting or jet milling.

The products hereof are also distinctive, as the powder particles in the post processing stage (i.e., after the hot gas contact step 14) are larger (i.e., plus or minus ten times (+/−10×) larger) than the starting materials (e.g., 5-6 precursor metal product vs. 44-76 μm for the metal powder product), but are combined in a manner not involving the melting of the precursor metal powder. Thus, the metal powder product comprises combinations or agglomerations of large numbers of smaller particles, each agglomeration being characterizable as a "soccer ball formed of 'BBs.'"

Figure 3:
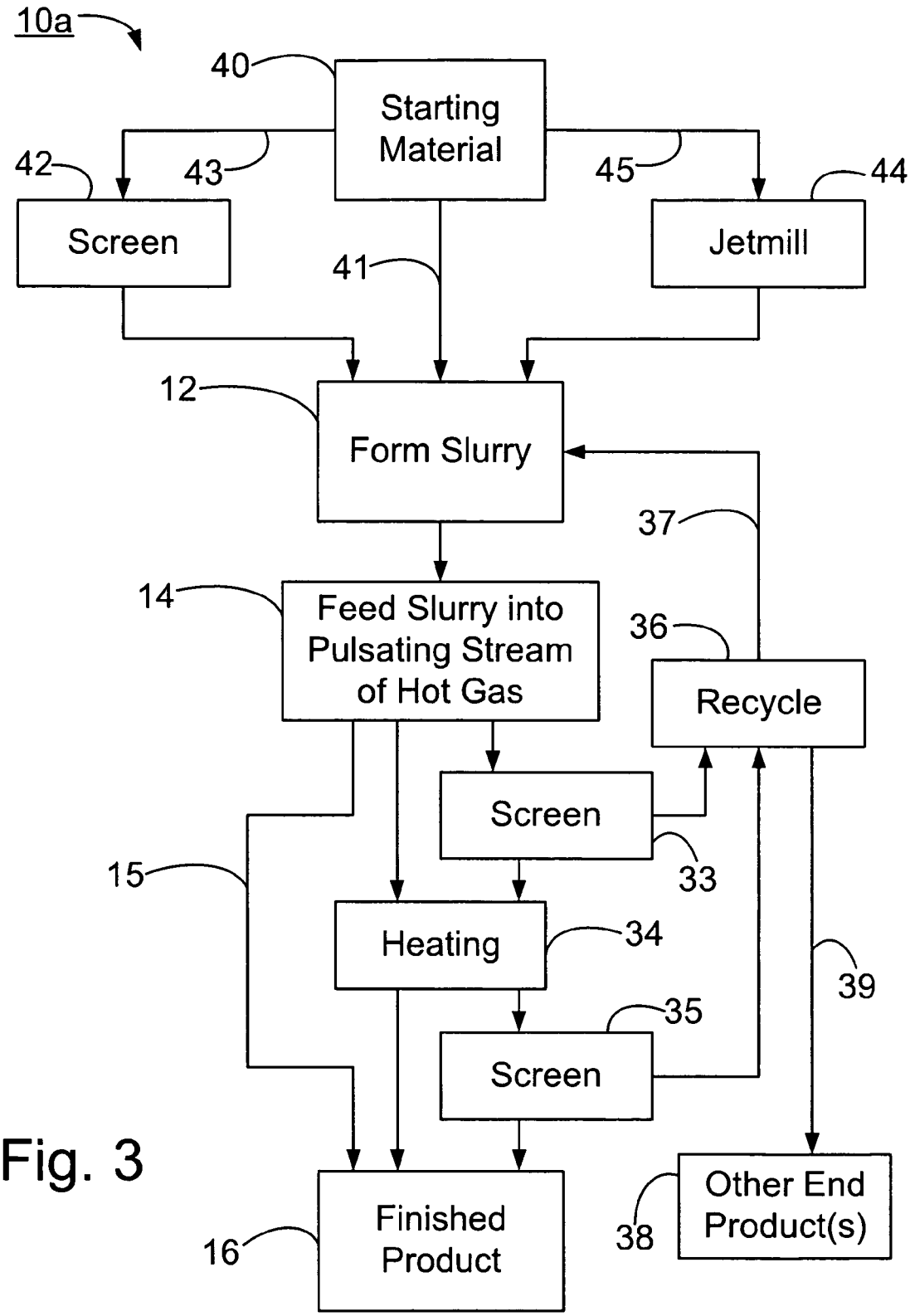
FIG. 3 is another flowchart depicting an alternative method according hereto.
Figure 4:
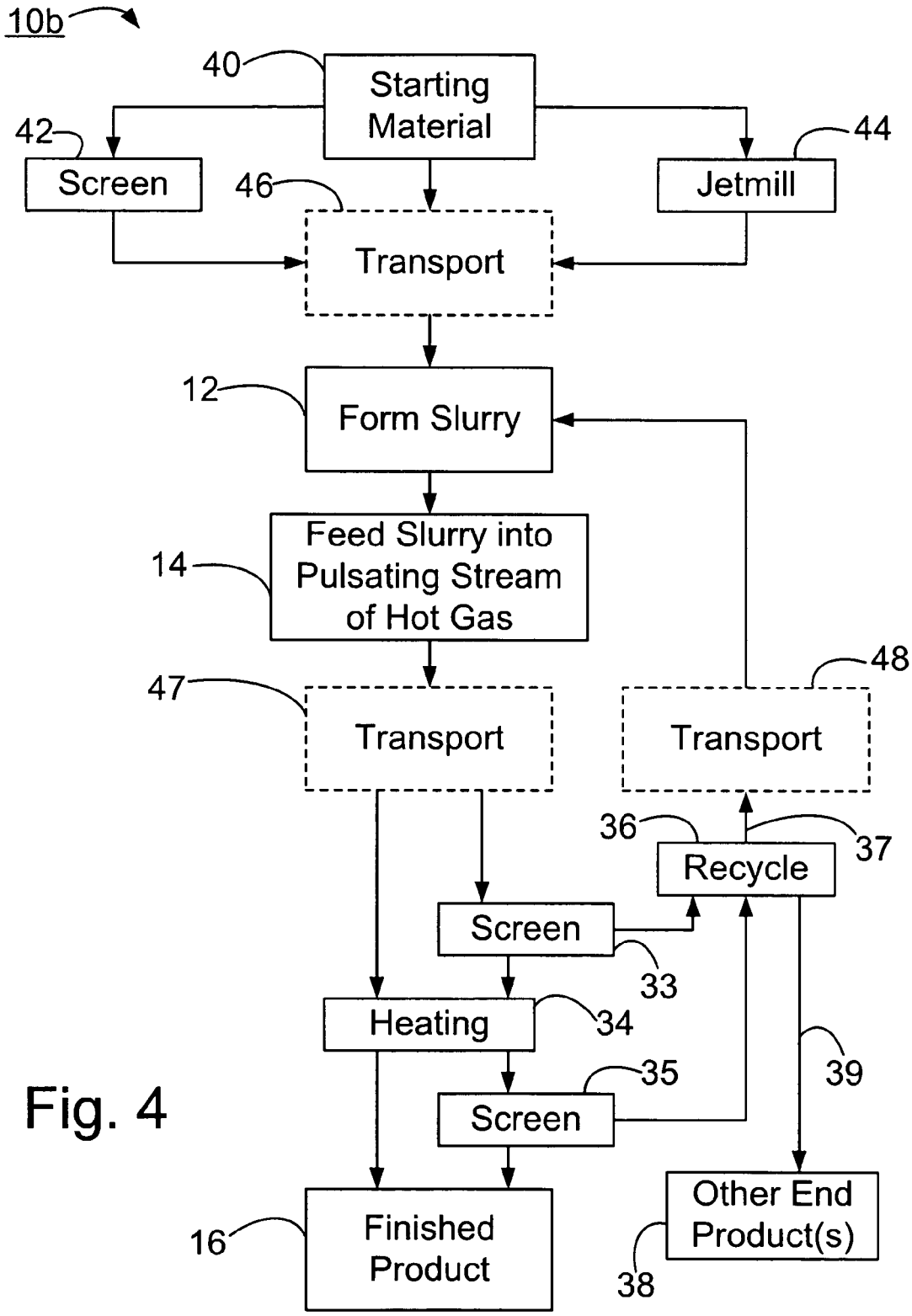
FIG. 4 is yet another flowchart depicting a further alternative method according hereto.
Figure 5:
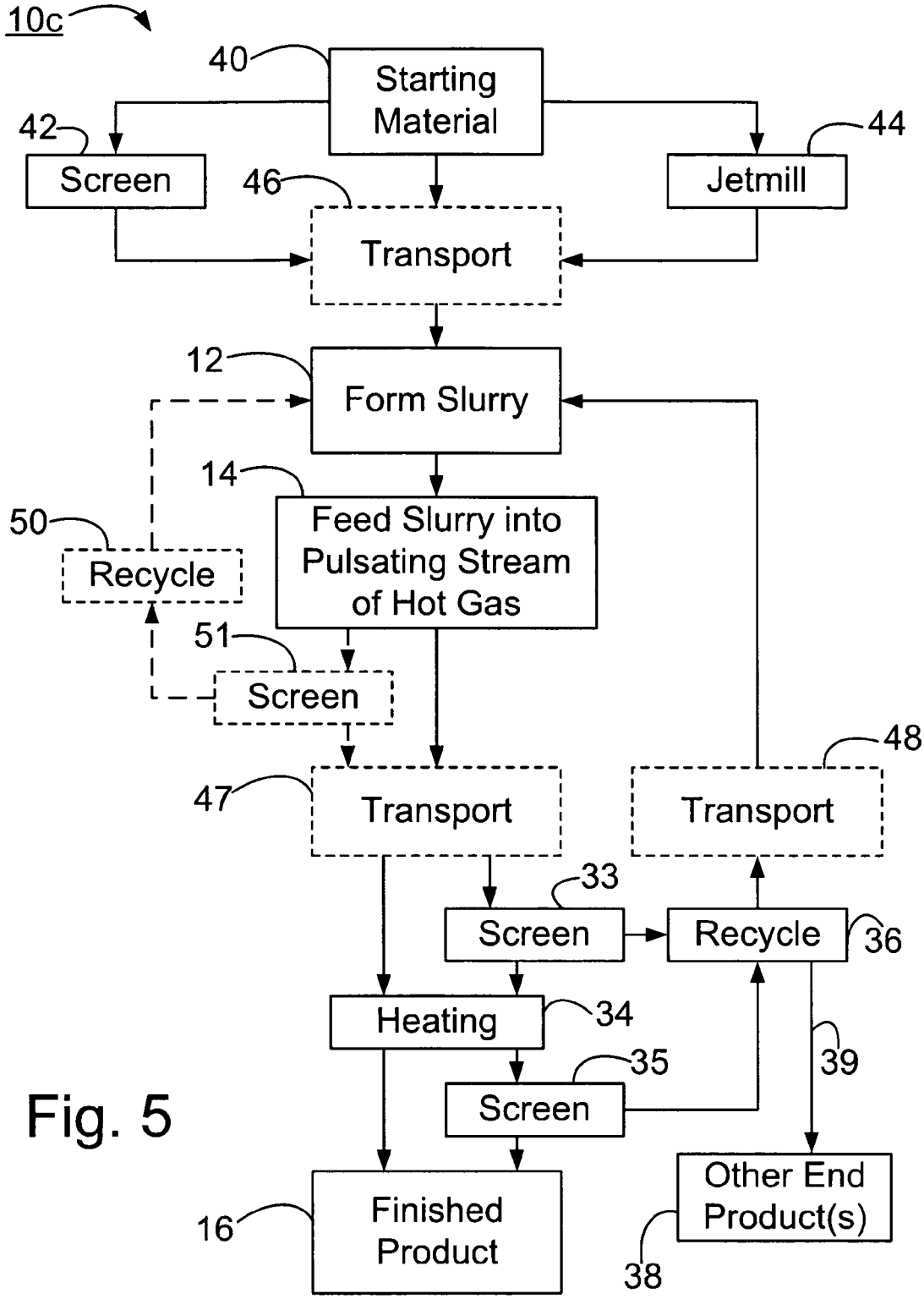
FIG. 5 is still another flowchart depicting yet one further alternative method according hereto.

Still further, it may be noted that additional pre- and/or post-processing steps may be added in some instances. For example, the precursor powder to be fed into the system may want some pre-processing to achieve a particular desired pre-processing size. Some such additional alternative steps are shown in FIGS. 3, 4 and 5, wherein the respective alternative processes 10*a*, 10*b* and 10*c* show the initial obtaining of a starting material at step 40, and from there either delivering this directly to the slurry making step, see arrow 41, or screening or jet milling the starting material, per steps 42 and/or 44 via alternative paths 43 and/or 45. As described further in the Examples below, a known, readily available precursor molybdenum powder having a size of about 14-15 μm may be used, though this may be preliminarily jet milled, see step 44, to the 5-6 μm size described herein.

FIGS. 4 and 5 present some additional alternative method steps which may provide additional utility and/or greater practicality. First, as shown in FIG. 4, three alternative additional steps for transportation, i.e., steps 46, 47 and 48, are shown. The purpose hereof may be based on the issue of the availability of pulse combustion system. More particularly, it may be necessary or desirable to transport the "raw" starting materials to the site of the pulse combustion system 100, per step 46, prior to the accomplishment of the other steps of the procedure. Note, it could also be that the slurry could be made at a location remote from the site of the pulse combustion system 100 as well so that the step 46 would instead be disposed between the "make slurry" step 12 and the "feed slurry into pulsating stream" step 14. A transport step 47 may then also be performed after the spraying step 14 is completed as is also shown by step 47 in FIG. 4. Then, any screening and/or heating, e.g., steps 33, 34, 35, could be performed if desired before achieving a metal powder product at step 16; although it is possible that such post-processing steps could alternatively be performed on site and thus the transport step 47 performed thereafter. If recycling is desired, a transport step 48 can be used to move recyclable powder particles back to the site of the pulse combustion system 100 to be re-formed into a slurry and re-introduced into the pulsating stream of hot gas. FIG. 5 adds two additional alternative steps 50 and 51 which provide for recycling, step 50, and/or screening, step 51, on-site at the location of the pulse combustion system 100.

It should be noted that the methods and apparatus described herein could be used to form a wide range of metal powder products from any of a wide range of precursor metal powders, including for example, substantially "pure" metals (e.g., any of a wide range of eutectic metals, non-eutectic metals and refractory metals), as well as mixtures thereof (e.g., metal alloys), understanding that in any alternative cases, certain modifications may be necessary (e.g., in temperatures, binders, ratios, etc.). This may be particularly so for either the lower melting point materials as well as for the refractory metals (having high melting points). Thus, differing mixture quantities (solids to water to binder) and/or differing temperatures and/or feed speeds may be desirably and/or necessarily established. Otherwise, the processes and/or products may be substantially similar to those described here. Moreover, even though some metals or other dense materials may have relatively low melting points, it may also still be that the processes hereof may yet be productive therewith as well in that the extremely short contact times may be sufficient to create end-products without melting, or at least without an undesirable degree of melting (e.g., melting may be allowable if some degree of melting were followed by sufficiently quick cooling and/or re-solidification prior to either extreme agglomeration or sticking within the machinery) . Different binders and/or suspension agents (i.e., alternatives to water) may also be found within the overall processes hereof, though again, perhaps indicating other changes in parameters (ratios, temperatures, speeds, for example).

EXAMPLES

Several examples according hereto have been run using molybdenum powder as a precursor metal powder having a size in a range of about 5-6 μm. As described herein, the first step involves the formation of a slurry at step 12, see FIGS. 1 and 3-5. In this instance, a water and binder mixture was first created. The resulting mixture was then heated to a temperature of about 71° C. (about 160° F.) to provide a desirable dispersion of binder in water, the binder in this first example being polyvinyl alcohol (PVA). The mixture was heated until the mixture was clear. The molybdenum precursor metal powder, comprising particles in a size range of about 5-6 μm, was then added to the heated water/binder mixture (which may be cooled before or during the adding of metal) and stirred to form a slurry comprising about 80 wt. % solids to about 20 wt. % water and binder liquids with an approximate 0.1 to about 1.0 wt. % of the total being binder (i.e., about 19 wt. % to about 19.9 wt. % water); about 0.4 wt. % to about 0.8 wt. % binder being preferred as described further below.

This slurry was then fed into a pulse combustion system 100 manufactured by Pulse Combustion Systems of San Rafael, Calif. 94901. The particular pulse combustion system

100 used had a thermal capacity of about 30 kW (about 100,000 BTU/hr) at an evaporation rate of about 18 kg/hour (about 40 lb/hour), whereupon the slurry was contacted by combustion gases produced by the pulse combustion system at step 14. The temperature of the pulsating stream of hot gases in this example was in the range of about 427° C. to about 677° C. (about 1050° F. to about 1250° F.). The pulsating stream of hot gases produced by the pulse combustion system 100 substantially drove-off the water to form the metal powder product. The contact zone and contact time were very short, the contact zone on the order of about 5.1 cm (about 2 inches) and the time of contact being on the order of 0.2 microseconds in this example.

The resulting metal powder product comprised agglomerations of smaller particles that were substantially solid (i.e., not hollow) and having generally spherical shapes. The metal powder product also had a comparatively high density and flowability when compared with conventional powders formed by conventional processes.

In this example, for molybdenum powder, the desired product size range was about 44 μm to about 76 μm, corresponding to sieve sizes of −200 to +325 U.S. Tyler mesh. The process yielded approximately 30 wt. % in this desired product size range. Metal powder product outside this size range was then recycled through the system with additional water and binder added to create the appropriate slurry composition. See FIGS. 1 and 3-5. Expanding the desired product size range somewhat, this example produced about 50 wt. % particles in sieve sizes of −100 to +325 U.S. Tyler mesh.

Note, pre- and/or post-procedures were also performed for these examples. Firstly, a known, readily available precursor molybdenum powder having particle sizes of about 14-15 μm was used, so it was first preliminarily jet milled, at step 44, to the 5-6 μm size described above. Also, the resulting metal powder product had remainder binder driven off (partially or entirely), by subsequent heating, see step 34, to about 1300° C. for molybdenum, which is still below the melting point of molybdenum. Post-processing screening was also performed to obtain the preferred mesh/sieve sizes. Smaller remainder products were, as mentioned, recycled.

Figure 6:
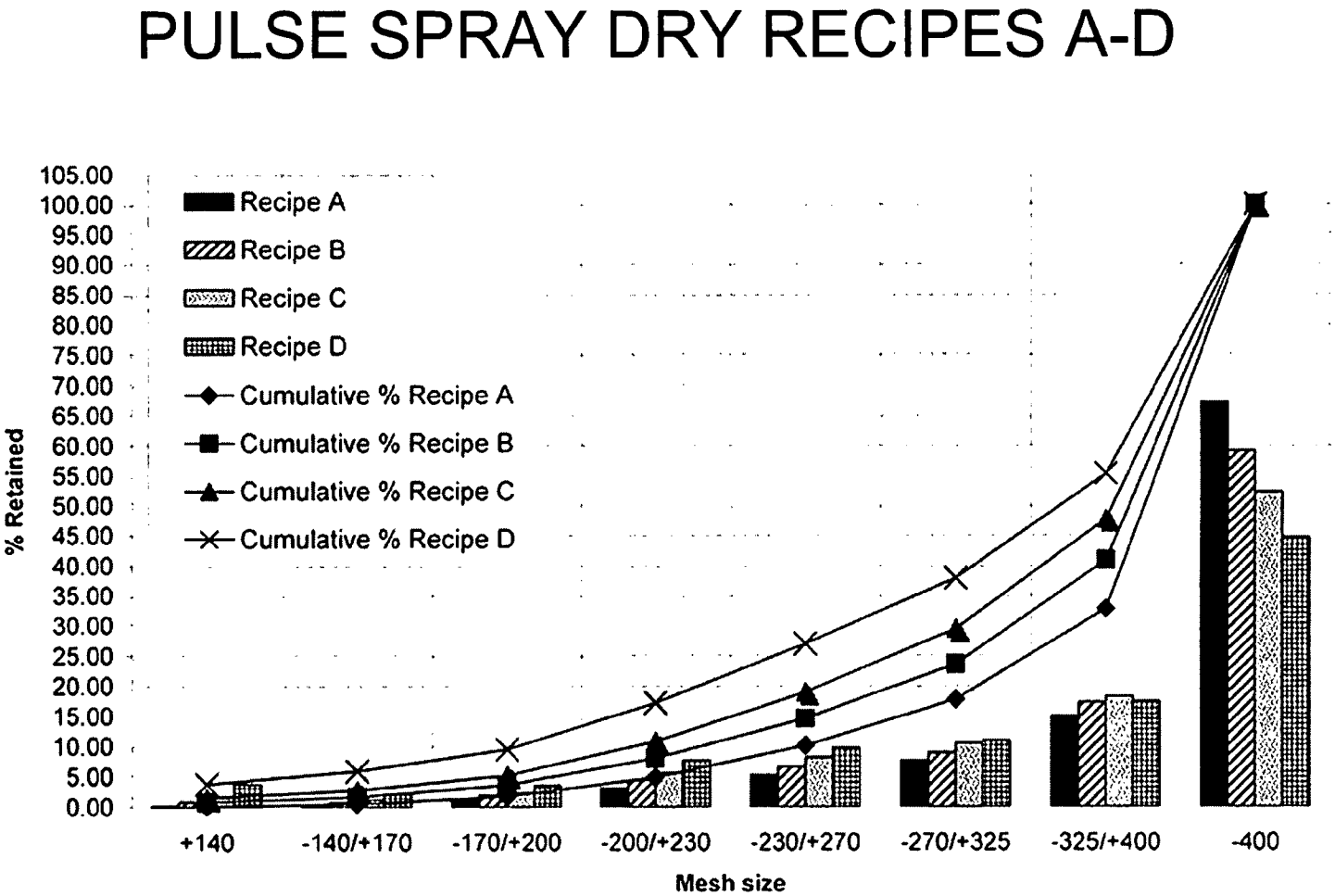
FIG. 6 is a graph showing the results of the practice of a method according hereto; and, FIG. 7 is a graph showing the results of the practice of a method according to the prior art.

The results of four exemplar runs according to this process are shown in FIG. 6, here arbitrarily designated as Recipes A, B, C and D. All four of these exemplar recipes were slurries made of about 80 wt. % solids (metal powders) and about 20 wt. % liquids, the variations being in the amount of binder; Recipe A having 0.5 wt. % PVA binder; Recipe B—0.6 wt. % PVA; Recipe C—0.7 wt. % PVA and Recipe D having 0.8 wt. % PVA; the remainders of the liquid portion being water. Then, what is shown for all four recipes run using the methods described herein are first very small amounts of large-size agglomerations, see the three left-hand columns representing U.S. Tyler mesh sizes +140; −140/+170; and −170/+200. The cumulative amounts of these large-size agglomerations are between about 2 and 10 percent of the total powders made for each batch. Next, in the three middle columns representing mesh sizes −200/+230; −230/+270; and −270/+325, are the accumulations of agglomerations in the sizes desired for the end-product molybdenum powders. The amounts of the desirable accumulations shown by these four examples are in the range of about 15 wt. % to about 30 wt. %. Recipe A provides the smaller amount, progressing through about 20 wt. % for Recipe B, about 25 wt. % for Recipe C and about 30 wt. % for Recipe D. Note, these accumulations are varied substantially directly based upon the differing amounts of binder added to the initial slurries. The last two columns reflect the amounts of smaller particles, agglomerations and/or un-reacted or substantially un-reacted metal powder elements passed through the process (between about 62 wt. % and about 82 wt. % in these examples). The highest binder content of these four samples, Recipe D, provides the largest realization percentage of desirable agglomerations. However, Recipe D also provides the highest amount of too-large agglomerations as well as the smallest amount of un-reacted particles. The lowest binder content (Recipe A) provided the least desirable size products, but also the least too-large agglomerations as well as the most un-reacted or substantially un-reacted particles. Based on the data for Recipes A, B, C, and D, it appears that a binder quantity of approximately between about 0.7-0.8 wt. % (e.g., about 0.75 wt. %) may provide one desirable optimization between desirable yields with favorable recyclability and satisfactory accumulations of the too-large agglomerations.

As mentioned, the larger binder quantity provides the larger amounts of oversized agglomerations, almost 10 wt. % for Recipe D. The smaller, un-reacted, or not quite large enough agglomerations can be simply recycled per step 36 in FIGS. 1 and 3-5.

Figure 7:
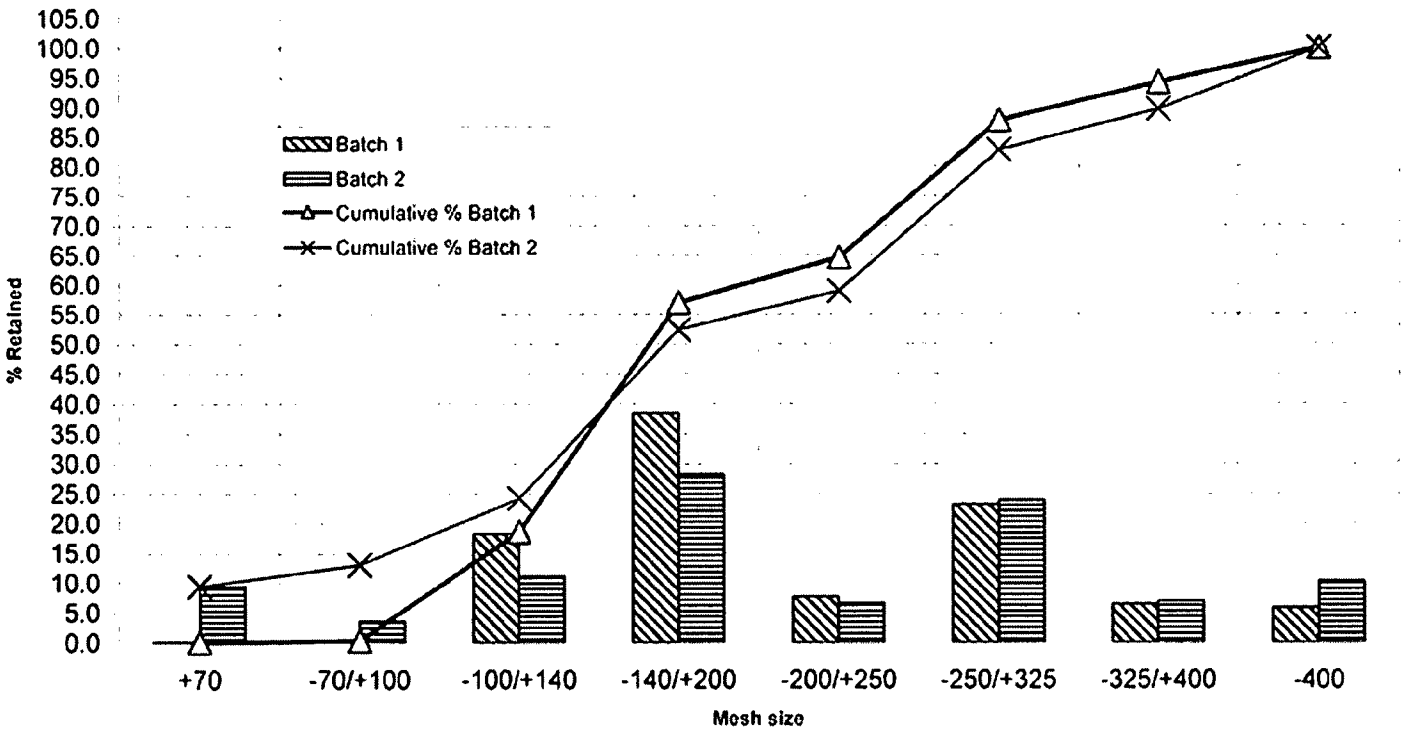
Fig. 7 Prior Art

In contrast, a typical conventional spray-drying method produced a powdered molybdenum metal product having the characteristics illustrated in FIG. 7. Briefly, the conventional spray-drying method involved a rotating atomizer disk contained in a heated atmosphere at a temperature of about 315° C. A slurry containing powdered molybdenum metal was then directed onto the rotating disk, whereupon it was accelerated generally outwardly by the rotating disk, the heated atmosphere serving to dry the molybdenum powder before being collected. As illustrated in FIG. 7, two batches of molybdenum metal powder are depicted as providing between about 52% and 57% of agglomerations in the first four columns thereof; these four columns providing oversized, large agglomerations outside the desired product size range. These also represent a substantial number of the hollow spheres described as a problem above. Moreover, the larger sizes also represent large wastes of binder. Further, this prior art process shows a bimodal operation in dropping to lower production amounts of the desired sizes, see the −200/+250 and the −250/+325 columns (although these two columns still account for product in the range of about 30% of the total), with small amounts of much smaller particles, see the −325/+400 and −400 column sizes.

Moreover, density and flow data are also favorable in the powders of the present invention. The respective batches 1 and 2 of the prior art process for forming molybdenum powders (whose sieve size results are shown in FIG. 7) had respective measured densities of about 1.8 and 1.9 g/cc on the Scott scale (the +325 powders being used for the density determinations). Additionally, the Hall flowability was on the order of about 50 s/50 g (50 seconds for the movement of 50 grams through a 0.1 inch orifice); batch 2 presenting about 53 seconds/50 g (again, the +325 powders being used for the flow determinations).

In comparison, the results of the four exemplar recipes of the present invention, on the other hand, presented higher densities of between about 2.75 and 2.9 g/cc apparent on the Scott scale; Recipe D having 2.75 g/cc; Recipe C—2.76 g/cc; Recipe B—2.83 g/cc; and Recipe A—2.87 g/cc; and, between about 2.67 and 2.78 g/cc apparent on the Scott scale; Recipe D having 2.67 g/cc; Recipe C—2.71 g/cc; Recipe B—2.77 g/cc; and Recipe A—2.78 g/cc. These greater densities of the present invention may be due primarily to the lack of hollow spheres as are found in the prior art spray-drying processes. Moreover, such densities are favored because this means more metal is available in a given volume of powder; more metal to be more efficiently used in any subsequent process using the end product powder hereof (as in coating processes, for example).

Furthermore, the Hall flowability results of the powders of the current invention also indicated a highly flowable metal powder product, ranging from about 20 s/50 g to about 22.3 s/50/g; more particularly, Recipe A—20.00 s/50 g; Recipe B—20.33 s/50 g; Recipe C—21.97 s/50 g; and Recipe D—22.28 s/50 g. These much faster flow rates also mean greater efficiency in any use of the metal powder product of the present invention.

It may also be noted that these data from the runs of Recipes A-D and the prior art batches 1 and 2 (see FIGS. 6 and 7 as well as the density and flow data above), was derived from the end product powders emerging from the pulse combustion machinery in green form (e.g., before performing optional heating step 34). Nevertheless, subsequent heating (e.g., at optional step 34) does not affect these results in any substantial way. The prior art spray-drying process still results in bi-modal outputs with substantially insignificant changes in density or flowability, while the present process continues to present Gaussian yield distributions with no significant changes in density or flowability.

In sum, the charts of FIGS. 6 and 7 and these density and flowability data show some of the advantages of the present invention. First, there is a bimodal distribution with conventional spray drying, see FIG. 7 and the above description. Although this bimodal distribution does partially land within the wanted material area, the present invention provides material that is Gaussian in the wanted area and not bi-modal, see FIG. 6. The distribution of the present invention may also be viewed as having a second curve (though it could still be considered Gaussian as shown here) outside the desired mesh sizes for the smaller particles; however, this second or extension of the curve representing the less than desirable end-product is comprised of substantially un-reacted material. This is unlike the non-Gaussian/bi-modal conventional spray drying process that rather demonstrates the yielding of material that is completely reacted, and too large for recycling. Moreover, the data from Recipes A-D show that the Gaussian curve in the wanted product region may be easily moved using different binder quantities. The chart of FIG. 6 shows that using higher levels of binder yields more reacted product and a shifting of the reacted product toward larger particles, see particularly Recipe D. The present invention also results in tighter yield distribution. This is a tighter distribution curve in usable area compared to bimodal curve from traditional spray drying of molybdenum.

Additionally, there are several advantages in the usual preferred reduction of the binder content in the present invention compared to conventional spray drying processes. Conventional spray drying generally uses about 1 wt. % binder compared to some of the preferred amounts of between about 0.1 wt. % to about 0.9 wt. %, including the 0.5 wt. % to 0.8 wt. % demonstrated ranges for molybdenum powder −200/+325 U.S. Tyler mesh. Indeed, often the higher binder amounts in the area of 1 wt. % can provide less desirable stickiness in the present process impacting flowability among other effects. Still furthermore, this lower binder content of the present invention processes yields higher purity products in the finished product powders due to fewer impurities being introduced at the beginning. Thus, the end-product materials produced here are of higher qualities/purities and have improved properties compared to those produced using conventional spray drying. The data shows flow time decreases (i.e., speedier flow rates equals decreased flow times) and density increases (no or at least substantially less hollow agglomerations) compared to conventional spray dried material.

Having herein set forth preferred embodiments of the present invention, it is anticipated that suitable modifications can be made thereto which will nonetheless remain within the scope of the invention. The invention shall therefore only be construed in accordance with the following claims:

The invention claimed is:

1. A method for producing a metal powder product, comprising:

providing a supply of a precursor metal powder;

combining said precursor metal powder with a liquid comprising water and a binder to form a slurry and heating the liquid and the binder before combining the precursor metal powder with the liquid and the binder;

feeding said slurry into a pulsating stream of hot gas; and recovering the metal powder product.

2. The method of claim 1, wherein heating the liquid and the binder comprises heating the liquid and the binder to a temperature of about 71° C.

3. A method for producing a metal powder product, comprising:

combining a binder with a liquid;

heating the combined binder and liquid;

adding a precursor metal powder to the combined binder and liquid to form a slurry;

providing a pulsating stream of hot gas in a direction;

introducing the slurry into the pulsating stream of hot gas toward the same direction; and recovering the metal powder product.

4. The method of claim 3, further comprising attaining a desired temperature of the pulsating stream of hot gas by blending quench air with the pulsating stream of hot gas.

5. The method of claim 3, further comprising at least partially driving off a liquid component of the recovered metal powder product.

6. The method of claim 5, wherein the at least partially driving off a liquid component includes heating the recovered metal powder product at a temperature below the melting point of the recovered metal powder product.

* * * * *